United States Patent [19]

Furuhashi

[11] 4,449,502

[45] May 22, 1984

[54] CONTROL SYSTEM FOR INTERNAL COMBUSTION ENGINE

[75] Inventor: Toshio Furuhashi, Mito, Japan

[73] Assignee: Hitachi, Ltd., Tokyo, Japan

[21] Appl. No.: 301,132

[22] Filed: Sep. 11, 1981

[30] Foreign Application Priority Data

Sep. 12, 1980 [JP] Japan ..... 55-126089

[51] Int. Cl.[3] ..... F02M 7/12

[52] U.S. Cl. ..... 123/440; 123/179 G; 123/479; 123/589

[58] Field of Search ..... 123/440, 489, 491, 179 G, 123/479, 480, 589, 179 L; 60/276, 285

[56] References Cited

U.S. PATENT DOCUMENTS

| | | | |
|---|---|---|---|
| 3,782,347 | 1/1974 | Schmidt et al. | 123/440 |
| 4,040,408 | 8/1977 | Kraus et al. | 123/179 L |
| 4,140,086 | 2/1979 | Schnurle et al. | 123/440 |
| 4,208,990 | 6/1980 | Asano | 123/440 |
| 4,216,653 | 8/1980 | Nakase et al. | 60/276 |
| 4,252,098 | 2/1981 | Tomczak et al. | 123/489 |
| 4,290,107 | 9/1981 | Suda et al. | 123/440 |

*Primary Examiner*—Andrew M. Dolinar

*Attorney, Agent, or Firm*—Antonelli, Terry & Wands

[57] ABSTRACT

A control system for controlling the opening degree of a solenoid valve provided in an air or fuel supplying system for engine to thereby control the air/fuel ratio of the gas mixture being supplied to the engine. This control system includes a device for accumulating the number of revolutions of the engine from the time the engine starts. When the accumulated value reaches a predetermined value, it is decided that the warming-up of engine is completed. Then, the output of the $O_2$ sensor for detecting the oxygen $O_2$ concentration in the exhaust gas is fed back to thereby perform the closed loop control for the air/fuel ratio. Before the accumulated value reaches the predetermined value, the closed loop control is performed without use of the output of the $O_2$ sensor.

13 Claims, 14 Drawing Figures

252

TAKE IN REVOLUTION SPEED OF ENGINE
S10
TAKE IN $O_2$ DATA
S11
268
S12
IS COUNT END INFORMED ?
YES
NO
S13
$O_2 \geqq O_2(1)$ OR $O_2 \leqq O_2(2)$?
YES
NO
S14
INDICATE FAILURE OF $O_2$ SENSOR
S15
RESET INDICATION OF $O_2$ SENSOR FAILURE
TAKE IN Tw DATA
S16
270
S17
IS COUNT END INFORMED ?
YES
NO
S18
Tw > Tws ?
YES
NO
S19
INDICATE FAILURE OF WATER TEMPERATURE SENSOR
S20
RESET INDICATION OF WATER TEMPERATURE SENSOR FAILURE
EXIT
260

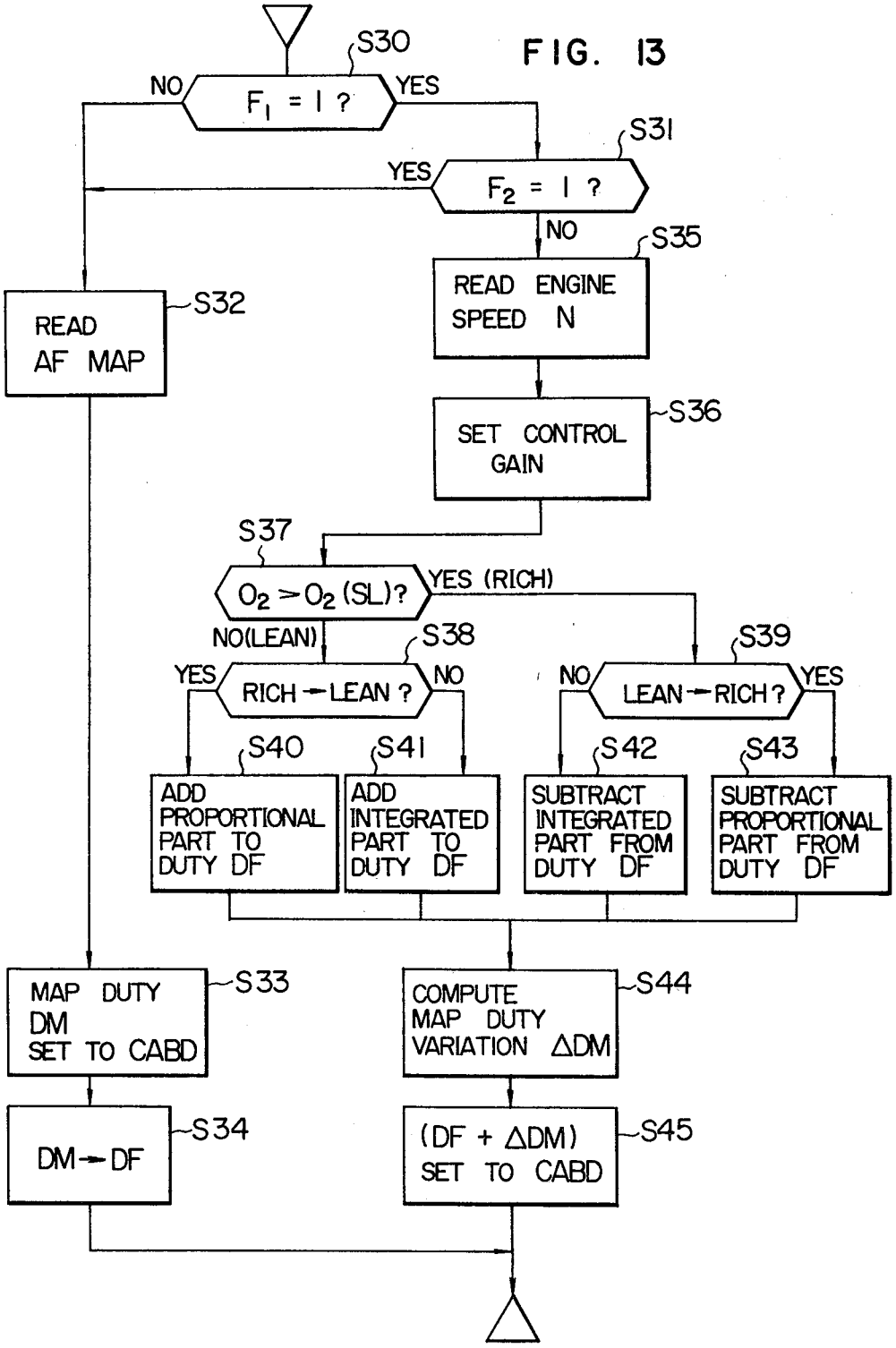
FIG. 13
S30
$F_1 = 1$ ?
NO
YES
S31
$F_2 = 1$ ?
YES
NO
S35
READ ENGINE SPEED N
S32
READ AF MAP
S36
SET CONTROL GAIN
S37
$O_2 > O_2$ (SL)?
YES (RICH)
NO(LEAN)
S38
RICH → LEAN ?
YES
NO
S39
LEAN → RICH ?
NO
YES
S40
ADD PROPORTIONAL PART TO DUTY DF
S41
ADD INTEGRATED PART TO DUTY DF
S42
SUBTRACT INTEGRATED PART FROM DUTY DF
S43
SUBTRACT PROPORTIONAL PART FROM DUTY DF
S33
MAP DUTY DM SET TO CABD
S44
COMPUTE MAP DUTY VARIATION ΔDM
S34
DM → DF
S45
(DF + ΔDM) SET TO CABD

CONTROL SYSTEM FOR INTERNAL COMBUSTION ENGINE

This invention relates to a control system for detecting the operating conditions of an engine by various sensors and thereby controlling the air/fuel ratio of an air-fuel mixture to the engine to be a proper value.

For internal combustion engines particularly gasoline engines of automobile, there have been various control systems to reduce harmful components in the exhaust gas. For example, in the control system disclosed in U.S. Pat. No. 4,208,990, a so-called $O_2$ sensor for detecting the oxygen concentration in the exhaust gas of engine in used, the output of which controls the opening degree of a solenoid valve for controlling the amount of the air bleed of the carburetor thereby to control the air/fuel ratio. Such $O_2$ sensor usable for controlling the air/fuel ratio is called "zirconia type", and generates an e.m.f. proportional to the concentration difference of oxygen. However, this kind of sensor, at temperatures at which the sensor is out of a predetermined active region, offers a great interval resistance and a small e.m.f., so that an effective output for controlling the air/fuel ratio cannot be produced from the sensor. Thus, the operating condition of the $O_2$ sensor, such as its temperature or interval resistance, is detected to decide whether the output of the $O_2$ sensor is effective or not. If the output of the $O_2$ sensor is ineffective, an open-loop control for the air/fuel ratio is performed with no use of this output. If the output of the $O_2$ sensor is effective, a closed-loop control for the air/fuel ratio is carried out with use of this output.

However, a special current applying means is required for detecting the interval resistance of the $O_2$ sensor. In addition, in the method for detecting temperature, there is a problem of the failure frequency of a temperature sensor which does not always assure that the closed-loop control can be started at a proper time. To compensate for this defect, it is possible that the closed-loop control is started if a constant time elapses after engine start or self cranking start. However, since the engine temperature or the $O_2$ sensor temperature after engine starts greatly changes depending on the manner warming-up of the engine, particularly on whether the throttle valve is opened or not, it is difficult to start the closed-loop control at a proper time.

In the control system in which exhaust gas recirculation (hereinafter, abbreviated as E.G.R.) is performed for reducing the nitrogen oxides within the exhaust gas, when the engine temperature is low, the EGR is not performed for preventing the aqueous vapor in the recirculating gas from its dew condensation. In the decision of whether or not the EGR is caused to start, there is the same problem as in the decision of whether the closed-loop control for the air/fuel ratio should be started or not.

Therefore, it is an object of this invention to provide an engine control system capable of properly deciding when the closed-loop control for the air/fuel ratio should be started. It is another object of the invention to provide an engine control system for properly deciding when the EGR should be started.

It is still another object of the invention to provide an engine control system for properly deciding whether any defective sensor of various sensors used for engine control is present or not.

It is further object of the invention to provide an engine control system capable of easy test for the functions of the control unit.

To achieve all the objects or part thereof, the number of revolutions of engine is accumulated from the time of the engine start, and when the accumulated value reaches a predetermined value, the time to start is decided at that time.

The temperature rise of engine, a predetermied time after the engine starts, is not merely the function of time, but must be caused by approximating to the amount of heat generated by combustion of fuel supplied so far. On the other hand, the amount of fuel supplied so far must be substantially proportional to the accumulated number of revolutions. Thus, eventually, the temperature of the engine can approximately be detected from the accumulated value of the number of revolutions of engine. Therefore, when approximately constant engine temperature is reached, independent of the operating condition of engine after its starting and the time lapse, difference control operations and failure examination can be started.

The above and other objects, features and advantages of the present invention will become more apparent from the following description taken in conjunction with the accompanying drawings, in which.

Figure 7:
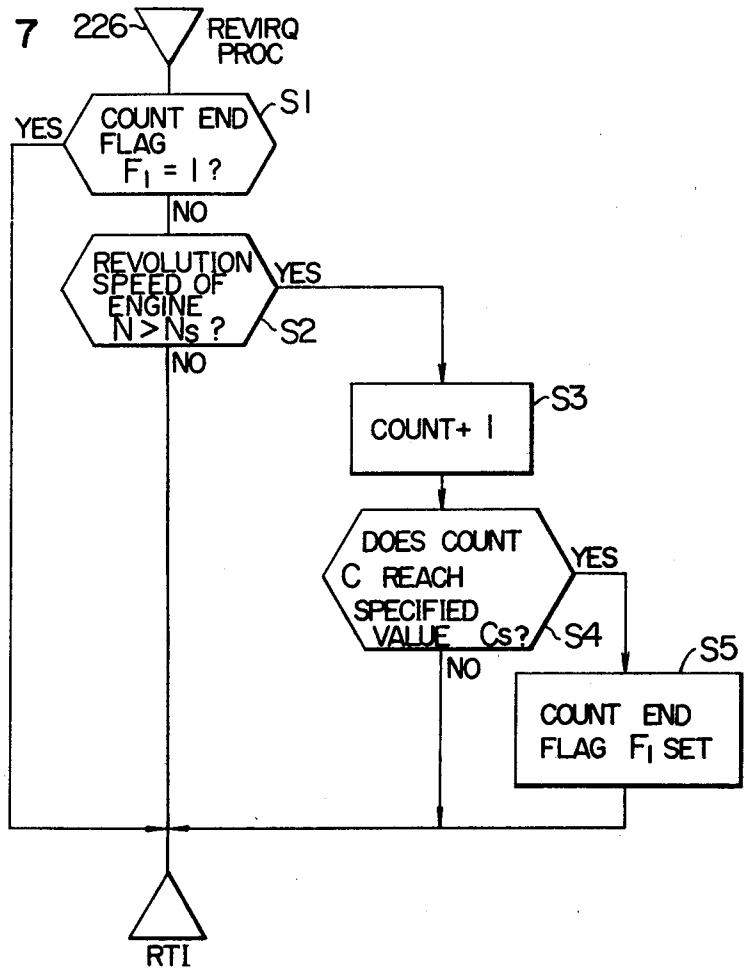
FIG. 7 is a flow chart of a program for accumulating the number of revolutions of an engine.
Figure 7A:
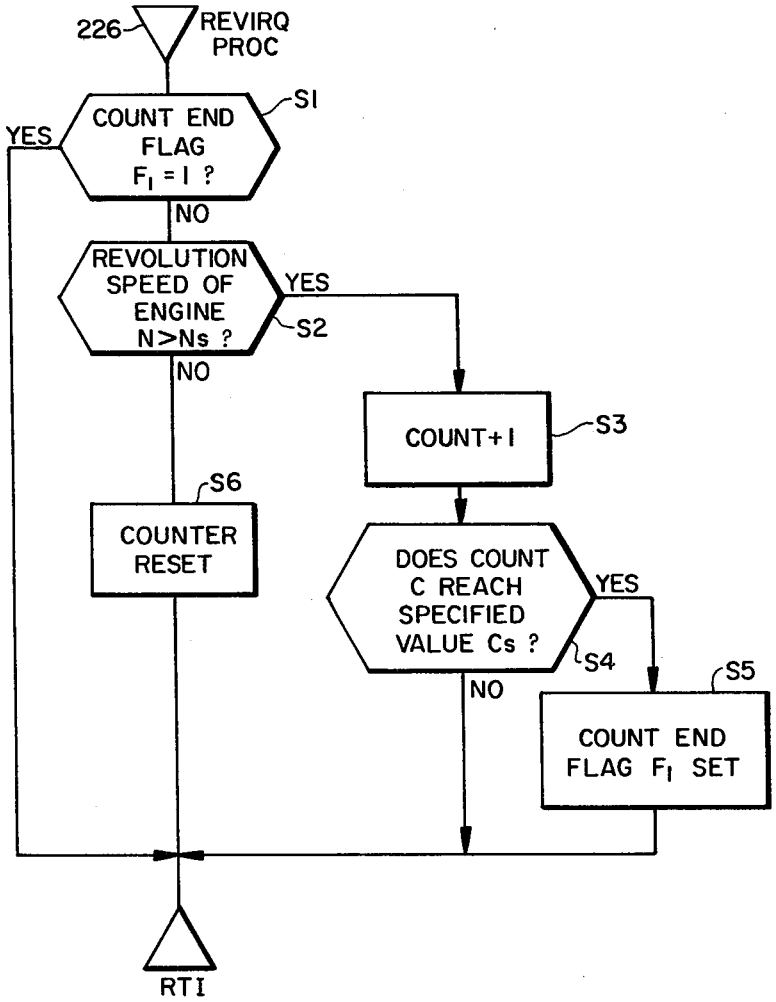

FIG. 7*a* is a flow chart of an alternate program for accumulating the number of revolutions of a engine.

Figure 8:
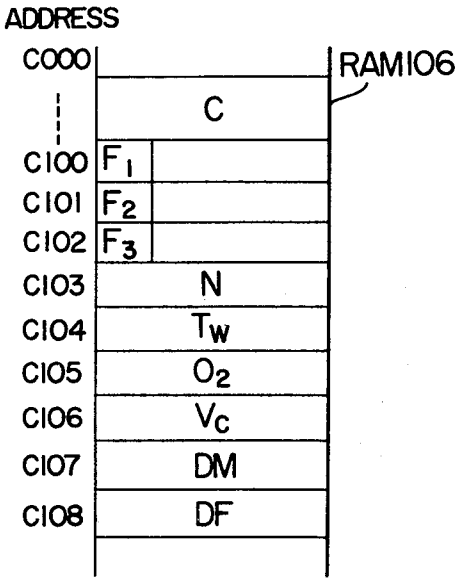
Figure 9:
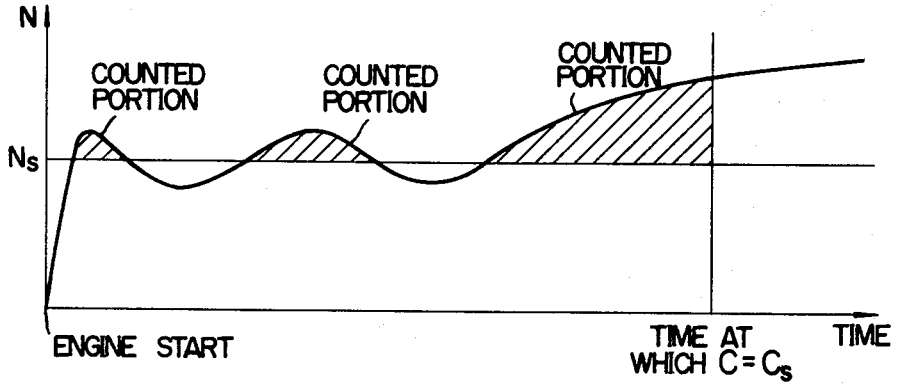
Figure 10:
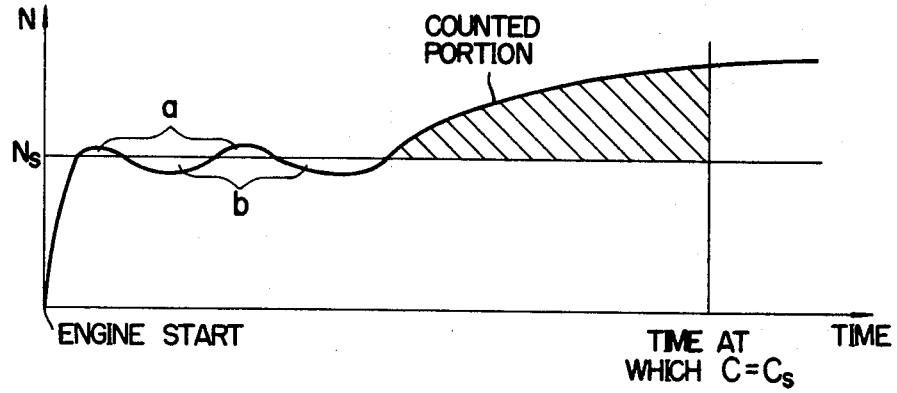
Figure 12:
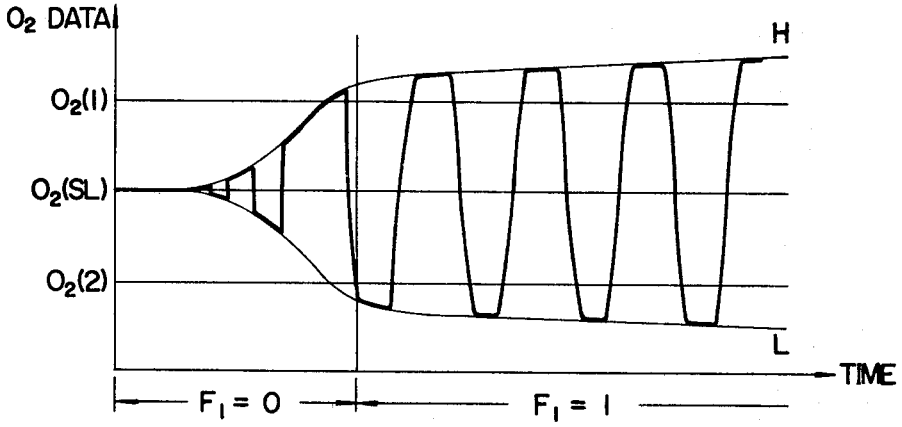
Figure 11:
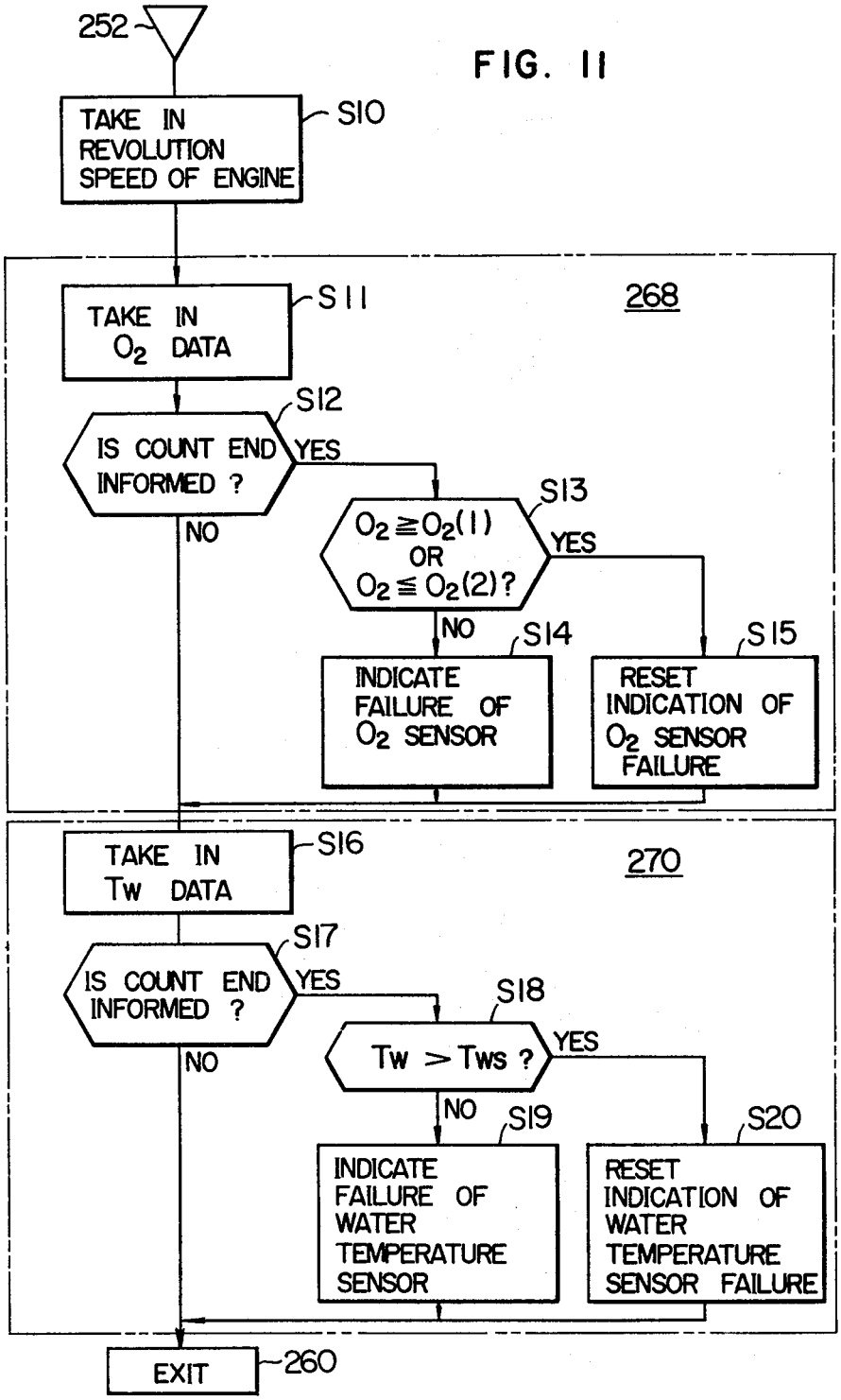

FIG. 8 is a schematic diagram showing the structure of RAM;

FIGS. 9 and 10 are timing charts for the accumulation of the number of revolutions of engine;

FIG. 11 is a flow chart of a program for failure examination;

FIG. 12 is a timing chart of the output of $O_2$ sensor; and

FIG. 13 is a flow chart of a program for controlling the air/fuel ratio.

Figure 1:
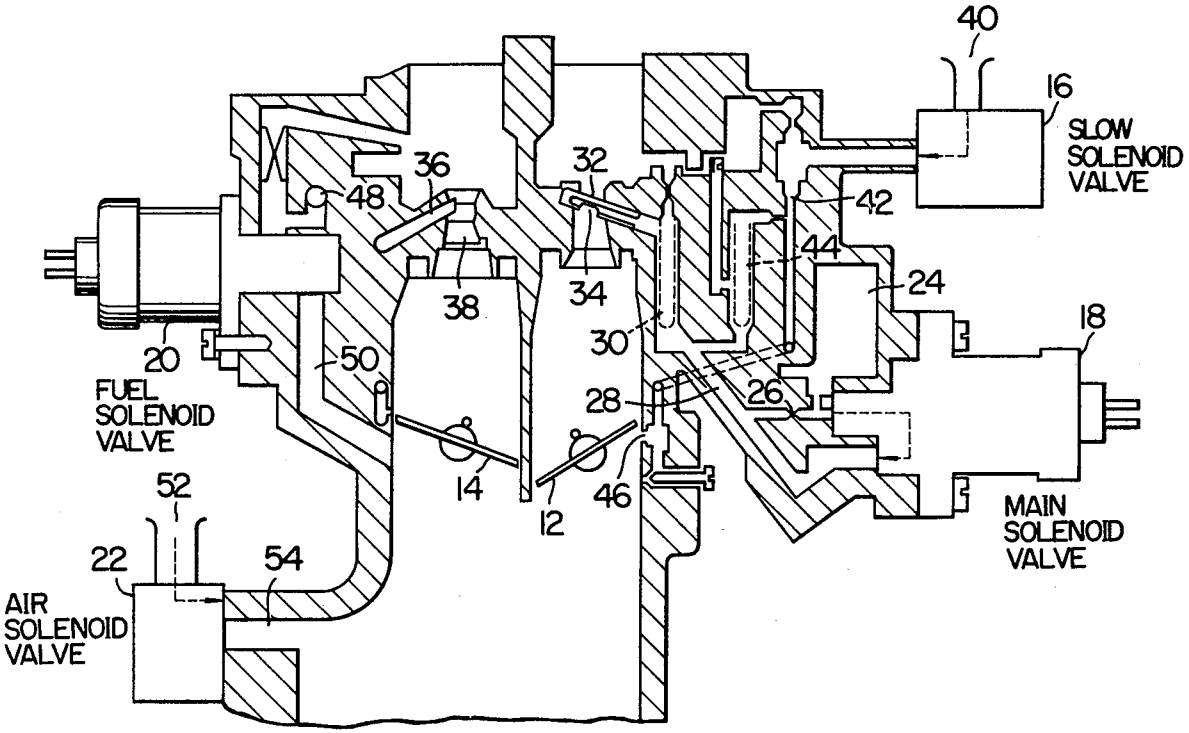
FIG. 1 is a sectional view of a throttle valve chamber in an embodiment of the invention.

As shown in FIG. 1, various solenoid valves 16 to 22 are provided around a throttle chamber (within a carburetor) to control a fuel quantity and a bypass air flow supplied to the throttle chamber.

Opening of a throttle valve 12 for a low speed operation is controlled by an acceleration pedal (not shown), whereby air flow supplied to individual cylinders of the engine from an air cleaner (not shown) is controlled. When the air flow passing through a venturi 34 for the low speed operation is increased as the result of the increased opening of the low-speed throttle valve 12, a throttle valve 14 for a high speed operation is opened through a diaphragm device (not shown) in dependence on a negative pressure produced at the venturi for the low speed operation, resulting in a decreased air flow resistance which would otherwise be increased due to the increased intake air flow.

The quantity of air flow fed to the engine cylinders under the control of the throttle valves 12 and 14 is detected by a negative pressure sensor (not shown) and taken in as an analog signal. In dependence on the analog signal thus produced and other signals available from other sensors which will be described later, the opening degrees of various solenoid valves 16, 18, 20 and 22 shown in FIG. 1 are controlled.

The fuel fed, from a fuel tank (not shown) through a conduit 24, is introduced into a conduit 28 through a main jet orifice 26. Additionally, the fuel in the conduit 24 is introduced to the conduit 28 through a main solenoid valve 18. Consequently, the amount of the fuel fed to the conduit 28 is increased as the opening degree of the main solenoid valve 18 is increased. The fuel is then fed to a main emulsion tube 30 to be mixed with air and supplied to the venturi 34 through a main nozzle 32. When the throttle valve 14 for high speed operation is opened, fuel is additionally fed to a venturi 38 through a nozzle 36 communicated to the main nozzle 32. On the other hand, the slow solenoid valve 16 is controlled simultaneously with the main solenoid valve 18. When the slow solenoid valve 16 is thus opened, air supplied from the air cleaner is introduced into a conduit 42 through an inlet port 40. The fuel fed to the conduit 28 is also supplied to the conduit 42 through a slow emulsion tube 44. Consequently, the amount of fuel supplied to the conduit 42 is decreased as the quantity of air supplied through the slow solenoid valve 16 is increased. The mixture of air and fuel in the conduit 42 is then supplied to the throttle chamber through a slow hole 46.

The fuel solenoid valve 20 serves to increase the fuel quantity for the engine starting and warming-up operations. The fuel introduced through a hole 48, communicating with the conduit 24, is fed to a conduit 50 communicating with the throttle chamber in dependence on the opening degree of the fuel solenoid valve 20.

The air solenoid valve 22 serves to control the quantity of air supplied to the engine cylinders. To this end, the air solenoid valve 22 is supplied with air from the air cleaner through an opening 52, whereby air is introduced into a conduit 54 communicating to the throttle chamber in a quantity corresponding to the opening degree of the air solenoid valve.

The slow solenoid valve 16 cooperates with the main solenoid valve 18 to control the fuel-air ratio (A/F) while the fuel solenoid valve 20 functions to increase the fuel quantity. Further, the engine speed at the idling operation is controlled through cooperation of the slow solenoid valve 16, the main solenoid valve 18 and the air solenoid valve 22.

Figure 2:
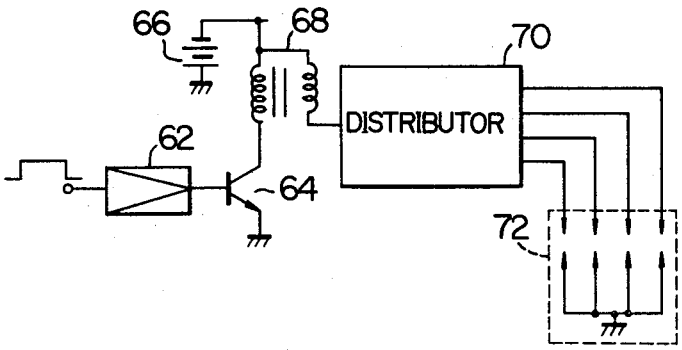
FIG. 2 is a circuit diagram of an ignition system.

Referring to FIG. 2, a pulse current is supplied to a power transistor 64 through an amplifier 62, as a result of which the power transistor 64 is turned on, whereby a primary current is caused to flow through a primary winding of an ignition coil 68 from a battery 66. In response to the trailing edge of the input current pulse, the transistor 65 is turned off, to cause a high voltage to be induced in the secondary coil of the ignition coil 68.

The high voltage thus induced is then supplied to spark plugs 72 of the individual cylinders of the engine through a distributor 70 in synchronism with the rotation of the engine.

Figure 3:
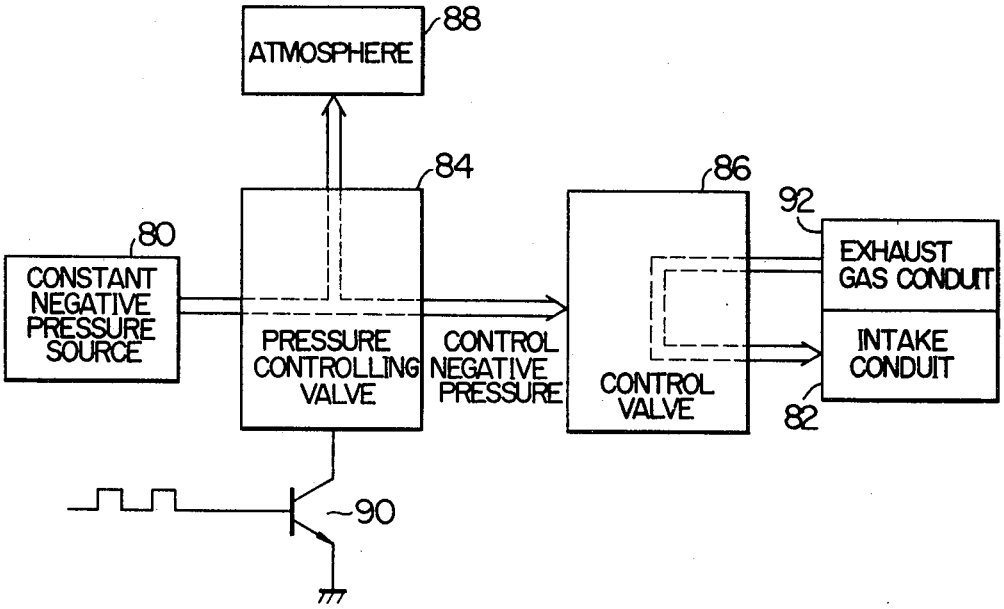
FIG. 3 is a block diagram of an exhaust gas recirculation system.

As shown in the EGR diagram of FIG. 3 a constant negative voltage, from a constant negative pressure source 80, is applied to a control valve 86 through a pressure controlling valve 84. The pressure controlling valve 84 serves to control the ratio at which the constant negative pressure from the negative pressure source 80 escapes to the atmosphere 88 in dependence on the duty cycle of a pulse signal applied to a transistor 90, thereby controlling the negative pressure level applied to the control valve 86. In other words, the negative pressure applied to the control valve 86 is determined on the basis of the duty cycle of the transistor 90. On the other hand, the quantity of recirculated exhaust gas from an exhaust conduit 92 to an intake conduit 82 is controlled by the control negative pressure applied from the constant pressure valve 84.

Figure 4:
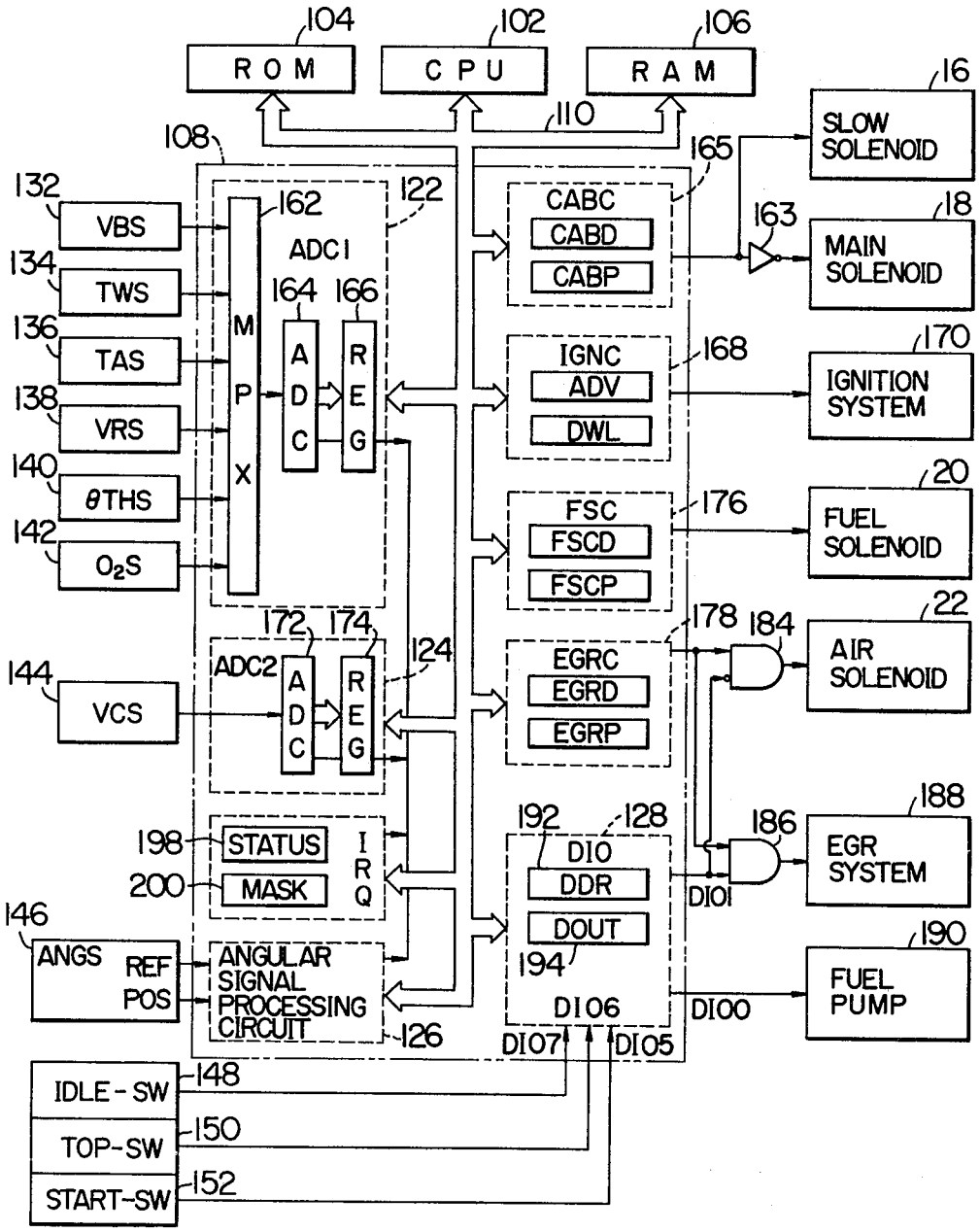
FIG. 4 is a block diagram of a whole control system.

As shown in FIG. 4, the control system includes a central processing unit (hereinafter, referred to as CPU) 102, a read-only memory (hereinafter, referred to as ROM) 104, a random access memory (hereinafter, referred to as RAM) 106, and an input/output interface circuit 108. The CPU 102 performs arithmetic operations for input data from the input/output circuit 108 in accordance with various programs stored in ROM 104 and feeds the results of arithmetic operation back to the input/output circuit 108. Temporal data storage, as required for executing the arithmetic operations, is accomplished by using the RAM 106. Various data transfer or exchanges among the CPU 102, ROM 104, RAM 106 and the input/output circuit 108 are realized through a bus line 110 composed of a data bus, a control bus and an address bus.

The input/output interface circuit 108 includes input means constituted by a first analog to digital converter 122 (hereinafter, referred to as ADC1), a second analog-to-digital converter 124 (hereinafter, referred to as ADC2) an angular signal processing circuit 126, and a discrete input/output circuit 128 (hereinafter, referred to as DIO) for inputting or outputting a single bit information.

The ADC1 122 includes a multiplexer 162 (hereinafter, referred to as MPX) which has input terminals applied with output signals from a battery voltage detecting sensor 132 (hereinafter, referred to as VBS), a sensor 134 for detecting temperature of cooling water (hereinafter, referred to as TWS), an ambient temperature sensor 136 (hereinafter, referred to as TAS), a regulated voltage generator 138 (hereinafter, referred to as VRS), a sensor 140 for detecting a throttle angle (hereinafter, referred to as $\theta$THS) and a $\lambda$ controlling sensor for $\theta_2$ (hereinafter, referred to as $O_2S$). The multiplexer, or MPX 162 selects one of the input signals to supply it to an analog-to-digital converter circuit 164 (hereinafter, referred to as ADC). A digital signal output from the ADC 164 is held by a register 166 (hereinafter, referred to as REG).

The output signal from a negative pressure sensor 144 (hereinafter, referred to as VCS) is supplied to the input of ADC2 124 to be converted into a digital signal through an analog-to-digital converter circuit 172 (hereinafter, referred to as ADC). The digital signal output from the ADC 172 is set in a register (hereinafter, referred to as REG) 174.

An angle sensor 146 (hereinafter, termed ANGS) is adapted to produce a signal representative of a standard or reference crank angle, e.g. of 180° (this signal will hereinafter be termed REF signal) and a signal representative of a minute crank angle, e.g. one crank angle (which signal will hereinafter be referred to as POS signal). Both of the signals REF and POS are applied to the angular signal processing circuit 126 to be shaped.

The discrete input/output circuit or DIO 128 has inputs connected to an idle switch 148 (hereinafter, referred to as IDLE-SW), a top gear switch 140 (hereinafter, termed TOP-SW) and a starter switch 152 (hereinafter, referred to as START-SW).

Next, description will be made on a pulse output circuit and objects to be controlled on the basis of the results of arithmetic operations executed by the CPU 102. A fuel-air ratio control device 165 (hereinafter, referred to as CABC) serves to vary the duty cycle of a pulse signal supplied to the slow solenoid valve 16 and the main solenoid valve 18 for the control thereof. Since increasing in the duty cycle of the pulse signal through control by the CABC 165 has to involve decreasing in the fuel supply quantity through the main solenoid valve 18, the output signal from the CABC is applied to the main solenoid valve 18 through an inverter 163. On the other hand, the fuel supply quantity controlled through the slow solenoid valve 16 is increased as the duty cycle of the pulse signal produced from the CABC 165 is increased. The CABC 165 includes a register (hereinafter, referred to as CABP) for setting therein the pulse repetition period of the pulse signal described above and a register (hereinafter, referred to as CABD) for setting therein the duty cycle of the same pulse signal. Data for the pulse repetition period and the duty cycle to be leaded in these registers CABP and CABD are available from the CPU 102.

An ignition pulse generator circuit 168 (hereinafter, referred to as IGNC) is provided with a register (hereinafter, referred to as ADV) for setting therein ignition timing data and a register (hereinafter, referred to as DWL) for controlling a duration of the primary current flowing through the ignition coil. Data for these controls are available from the CPU 102. The output pulse from the IGNC 168 is applied to the ignition system denoted by 170 in FIG. 4. The ignition system 170 is implemented in such arrangement as described hereinbefore by referring to FIG. 2. Accordingly, the output pulse from the IGNC 168 is applied to the input of the amplifier circuit 62 shown in FIG. 2.

A fuel increasing pulse generator circuit 176 (hereinafter, referred to as FSC) serves to control the duty cycle of a pulse signal applied to the fuel solenoid valve 20 shown in FIG. 1 for the control thereof and includes a register for setting therein the pulse repetition period of the pulse signal (this register will be hereinafter referred to as FSCD) for setting the duty cycle of the same pulse signal.

A STATUS register 198 is provided to enable examining what factors the IRQ is caused by, and a MASK register 200 inhibits the IRQ.

A pulse generator circuit 178 (hereinafter, referred to as EGRC) for producing a pulse signal to control the quantity of exhaust gas to be recirculated (EGR) includes a register (hereinafter, termed EGRP) for setting the pulse repetition period and a register (hereinafter, termed EGRD) for setting the duty cycle of the pulse signal. The repetition pulse is applied to the air solenoid valve 22 through an AND gate 184, which is also supplied with the output signal DEO1 from the DIO 128. When the signal DIO1 is at a level "L", the AND gate 184 is enabled to conduct therethrough the control pulse signal for controlling the air solenoid valve 22.

On the other hand, when the signal DIO1 is at a level "H", an AND gate 186 is made conductive to control a EGR system 188, the fundamental function illustrated in FIG. 3 is carried out.

In FIG. 4 DIO 128 is an input/output circuit for signal bit signal as described above and includes to this end a register 192 (hereinafter, referred to as DDR) for holding data to determine the output or input operation, and a register 194 (hereinafter, referred to as DOUT) for holding data to be outputted. The DIO 128 produces an output signal DIOO for controlling the fuel pump 190.

Figure 5:
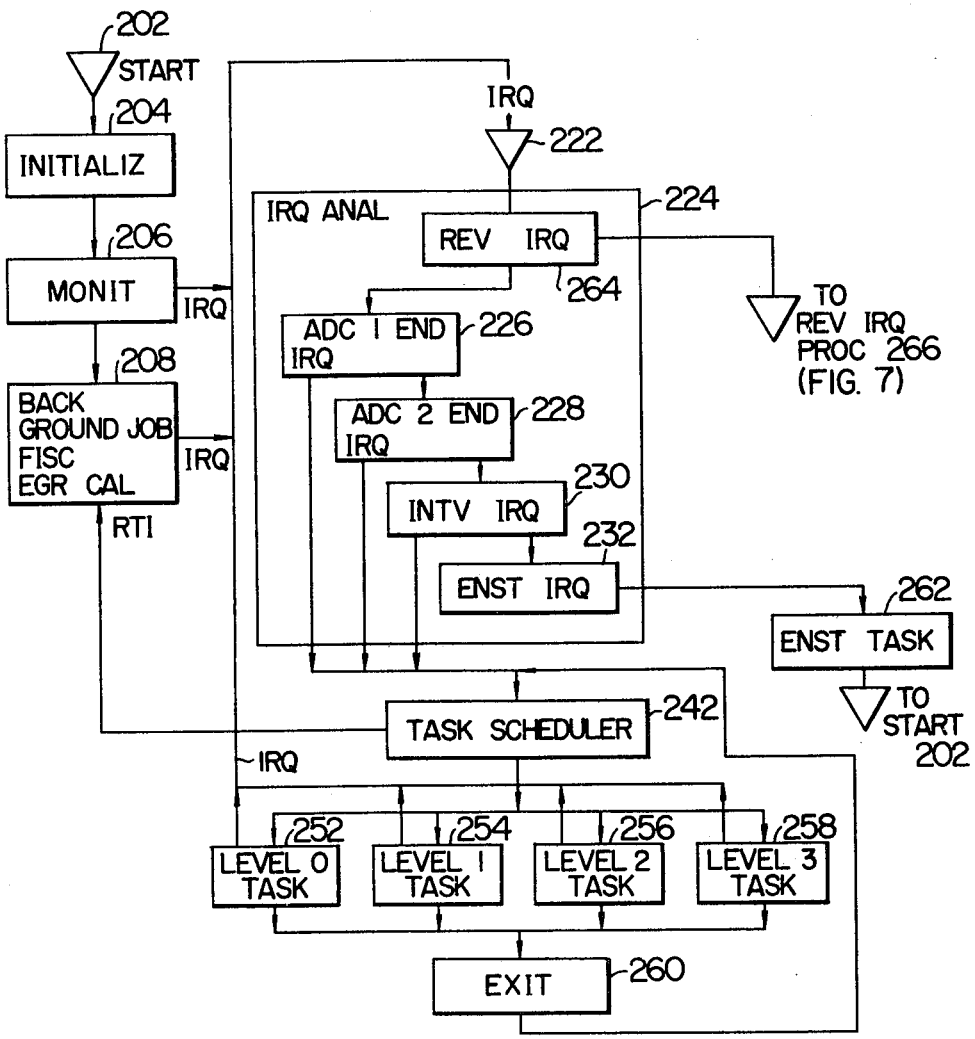
FIG. 5 shows a flow chart of a program system.

FIG. 5 illustrates a flow chart of a program system for the control circuit in FIG. 4. When a power supply is turned on by a key switch (not shown), the CPU 102 is set in a start mode to execute an initialization program (INITIALIZ) 204. Subsequently, a monitor program (MONIT) 206 is executed, which is followed by execution of background job (BACKGROUND JOB) 208. The background jobs include, for example, task for calculating the quantity of EGR (hereinafter, referred to as EGR CAL task) and task for calculating the control quantities for the fuel solenoid valve 20 and the air solenoid valve 22 (hereinafter, referred to as FISC). When an interrupt request (hereinafter, termed IRQ) occurs during the execution of these tasks, an IRQ analyzing program 224 (hereinafter, termed IRQ ANAL) is executed from the start step 222. The program IRQ ANAL is constituted by a rotation interrupt (hereinafter, referred to as REVIRQ) program 264, an end interrupt processing program 226 for the ADC1 (hereinafter, referred to as ADC1 END IRQ), an end interrupt processing program 228 for the ADC2 (hereinafter, referred to as ADC2 END IRQ), an interval interrupt processing program 230 (hereinafter, referred to as INTV IRQ), and an engine stop interrupt processing program 232 (hereinafter, referred to as ENST IRQ).

The REVIRQ is started by a timing pulse which is supplied from the IGNC 168 to an ignition system 170. That is, for a 4-cylinder engine, the REVIRQ is started twice per revolution of engine. When the REVIRQ occurs, a revolution interrupt processing routine 266 (hereinafter, referred to as REVIRQPPOC) which will be described later with reference to FIG. 7 is executed. When the REVIRQPROC 266 ends, the program progresses to RTI and the background job 208 is again executed.

The ADC1 END IRQ 226 and ADC2 END IRQ 228 are started each time the analog to digital conversion at ADC1 and ADC2 ends. The INTVIRQ 230 is started each time a timer (not shown) incorporated in the CPU 102 counts up.

In these interrupt processing programs, a start request (hereinafter, referred to as QUEUE) is issued to a necessary task of a task group 252 of level "0", a task group 254 of level "1", a task group 256 of level "2" or a task group 258 of level "3". The task to which the request QUEUE is issued from the program ENST IRQ 232 is a task 262 for processing the stopping of the engine (this task will hereinafter referred to as ENST TASK). When the ENST TASK 262 has been executed, the control system is set back to the start mode and the program is returned to the start step 202.

A task scheduler 242 serves to determine the sequence in which the task groups are executed such that the task groups to which the request QUEUE is issued or execution of which is interrupted are executed starting from the task group of the highest level (here, level "0" is taken as the highest level). Upon execution of the task group being executed, a termination indicating program 260 (hereinafter, referred to as EXIT) is executed to inform this fact to the task scheduler 242. Subsequently, the task group of the next highest level among those in QUEUE is executed and so forth.

When there remains no task group the execution of which is interrupted or to which the request QUEUE is issued, the execution of the background jobs 208 is regained under the command of the task scheduler 242. Further, when IRQ is issued during execution of the task group among those of level "0" to "3", the starting step 222 of the IRQ processing program is regained.

Table 1 lists the initiations and functions of the individual task programs.

TABLE 1

| Level | Programs | Functions | Activation (timing) |
|---|---|---|---|
| — | IRQ ANAL | Analysis of IRQ and issue of requests for activating task groups or tasks | IRQ |
| — | TASK SCHEDULER | Determination of task groups or tasks to be executed | End of IRQ ANAL or end of EXIT |
| — | EXIT | Informing of ended executions of task groups | End of individual task groups |
| 0 | AD1IN | Fetching of output from ADC1 | INTV IRQ (10 m. sec.) or ADC1 END |
| | AD1ST | Initiation of ADC1 | INTV IRQ (10 m. sec.) |
| | AD2IN | Fetching of output from ADC2 | INTV IRQ (10 m. sec.) or ADC2 END |
| | AD2ST | Initiation of ADC2 | INTV IRQ (10 m. sec.) |
| | RPM1N | Fetching of engine speed | INTV IRQ (10 m. sec.) |
| 1 | CARBC | Calculation of duty cycle for controlling fuel-air ratio | INTV IRQ (20 m. sec. ) |
| | IGNCAL | Calculation of ignition timing | INTV IRQ (20 m. sec.) |
| | DWLCAL | Calculation of duration of primary current through ignition coil | INTV IRQ (20 m. sec.) |
| 2 | LAMBDA | Control of λ (A/F closed loop control) | INTV IRQ (40 m. sec.) |
| 3 | HOSEI | Calculation of corrections | INTV IRQ (100 m. sec.) |
| — | FISC | Calculation for positioning fuel valve and air valve | BACKGROUND JOB |
| — | EGRCAL | Calculation for positioning negative pressure-controlled valve for EGR | BACKGROUND JOB |
| — | INITLIZ | Setting initial valves at input/output circuit | START OR RESTART |
| — | MONIT | Monitoring of START-SW and starting of fuel pump | START or RESTART |
| — | ENST TASK | Stop of fuel pump and resetting of IGN | ENST IRQ |

As can be seen from the above Table 1, there are programs for monitoring or supervising the control system illustrated in FIG. 5 such as programs IRQ ANAL, TASK, SCHEDULER and EXIT. These programs (hereinafter, referred to as OS) are held in ROM 104 at addresses A000 to A300 as shown in FIG. 6.

As the program of level "0", there are AD1ST, AD2IN, AD2ST, and RPMIN, which are activated usually by INTV IRQ produced for every 10 m sec. Programs of level "1" includes CARBC, IGNCAL, and DWLCAL programs, which are activated for every INTV IRQ produced periodically at time intervals of 20 m. sec. As the program of level "2", there is LAMBDA, which is activated by INTV IRQ for every 40 m. sec. The program of level "3" is HOSEI which is activated by INTV IRQ for every 100 m. sec. The programs EGRCAL and FISC are for the background jobs. The programs of level "0" are stored in ROM 104 at addresses A700 to AAFF as PROG1, as shown in FIG. 6. The level "1" programs are stored in ROM 104 at addresses AB00 to ABFF as PROG2. The level "2" programs are stored in ROM 104 at addresses AE00 to AEFF as PROG3. The program of level "3" is stored in ROM 104 at addresses AF100 to AFFF as PROG4. The program for the background jobs is held at B000 to B1FF. A list (hereinafter, referred to as SETMR) of the start address of the programs PROG1 to PROG4 described above is stored at addresses B200 to B2FF, while values representative of the activation periods of the individual programs (hereinafter, referred to as TTM) from PROG1 to PROG4 are stored at addresses B300 to B3FF.

Figure 6:
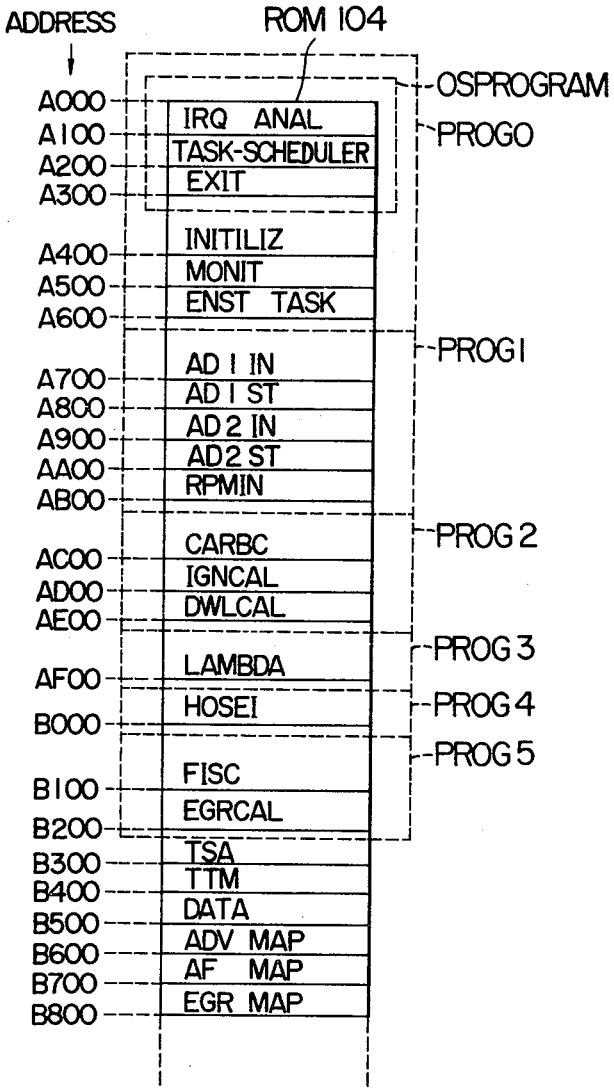
FIG. 6 is a schematic diagram showing the structure of ROM.

Other data as required are stored in ROM 104 at addresses B400 to B4FF, as is illustrated in FIG. 6. In succession thereto, data ADV. MAP, AF. MAP and EGR. MAP are stored at B500 to B7FF.

FIG. 7 is a flow chart of REVIRQPROC 266. First, at step 1 (S1), it is checked whether the count end flag F1 is at level "1" or not. The flag F1 is stored at a specific address C100 of the RAM 106 as shown in FIG. 8. When the F1 is at level "1", the counter which will be described later counts up to a specified value, indicating that the closed loop control and EGR for the air-fuel ratio can be started. If the result at this step S1 is YES, it is unnecessary to execute the REVIRQPROC 266, and thus the program proceeds to the RTI, where the background job 208 is executed. If the result at S1 is NO, the program is progressed to the S2 where the program RPMIN which will be described later decides whether the revolution speed N of engine stored in the RAM 106 at the address C 103 is larger than a predetermined speed $N_S$ or not. If not so, the program goes to the RTI and thus any substantial routine is not executed. On the other hand, if the result at step S2 is YES, the program goes to S3, where 1 is added to the contents of the counter which are one of the addresses C000 to C0FF of the RAM 106 as shown in FIG. 8. Then, at step S4, decision is made of whether the count C of the counter reaches a specified value $C_S$ or not. If not so, the program goes to the RTI, thus this routine being finished.

If the result at S4 is YES, the program proceeds to step S5 where the count end flag F1 at the address C 100 of the RAM 106 is set. Thus, the REVIRQPROC 266 has been executed, then going to the RTI.

In this way, each time the engine rotates half the complete revolution, the REVIRQ 264 is operated, and the REVIRQPROC 266 is executed. As step S2 of REVIRQPROC 266, only when the rotation speed N of engine exceeds a predetermined speed $N_S$ (for example, 1000 rpm.), the counter progresses. When the contents of the counter reaches a predetermined value $C_S$, the count end flag F1 is set. These operations are shown in FIG. 9. The specific value $C_S$ is determined by the capacity of engine, usually from 20,000 to 40,000. In other words, when the number of revolutions of engine after the engine has started rotating reaches 10,000 to 20,000, the count end flag F1 is set.

The reason why, as shown in FIG. 7, decision is made at S2, and if the rotation speed N is less than a predetermined value $N_S$, the counter does not progress in its contents, is that when the rotation speed of engine is low, the amount of heat generated per unit time is small, which does not contribute to the temperature rise at the engine and $O_2$ sensor.

In this case, the routine of FIG. 7 may be modified such that if the result at step S1 is YES, the routine goes directly to step S3 with S2 omitted, in which case the revolutions after start of engine are all accumulated, and the count end is informed.

In another embodiment shown in FIG. 7*a*, an additional step S6 is provided so that whenever the result at S2 is No, the counter is Reset to zero. In accordance with this the embodiment of FIG. 7*a*, the counts in the range of the hatched area in FIG. 10 are accumulated, but the counts in the area a is reset to zero when the revolutions of engine decreases from area a to area b. In other words, in this embodiment, after the engine starts rotating and enters into a considerably stable rotating condition with little ripple, only the revolutions are accumulated. Therefore, the approximation to the warming-up end time can be more improved depending on engine.

FIG. 11 is a flow chart of the RPMIN program for executing the tasks concerning this invention, of the tasks listed in Table 1.

This program is activated by the INTVIRQ at every 10 m. sec. First, at step S10, data of revolutios N of engine is read from the ANGS 146 in FIG. 4 and written in the RAM 106 at address C 104.

Subsequently, a fault examination routine 268 by the $O_2$ sensor 142 (FIG. 4) and then a fault examination routine 270 by the cooling water temperature sensor 134 are executed, to reach the EXIT 260.

First, at step S11, the digital data $O_2$ to which the output of the $O_2$ sensor 142 is converted is read, and set in the RAM 106 at address C105. At step S12, check is made of whether the count end flag F1 is set in the RAM 106 at address C 100. If the result at step S12 is NO, the program proceeds to the next routine 270 without substantial processing in the routine 268 because the warming-up operation is not complete.

If the result at step S12 is YES, the program proceeds to step S13 where decision is made of whether the data $O_2$ has ever been become larger than a specified value $O_2$ (1) or less than a specified value $O_2$ (2). Here, the condition between the specified values $O_2$ (1) and $O_2$ (2) is given by $$O_2(1) > O_2(2)$$

If the result at step S13 is NO, the $O_2$ sensor 142 is decided to be defective and the program goes to step S14, where the $O_2$ sensor fault flag F2 at address C 101 of the RAM 106 (see FIG. 8) is set. On the other hand, if the result at step S13 is YES, the $O_2$ sensor fault flag F2 is reset at step S15.

Thus, the $O_2$ sensor can be examined for its fault by deciding whether or not the data $O_2$ has been become larger than the specified value $O_2$ (1) or smaller than the specified value $O_2$ (2), as will be understood from FIG. 12. The $O_2$ sensor is provided with a current control means for making the sliced level constant thereby to decide whether the $O_2$ concentration in the exhaust gas is larger or smaller then a specified values. This $O_2$ sensor thus detects the concentration of $O_2$ in the exhaust gas to indicate a value of H when it is smaller than a specified value, or a value of L when it is larger than a specified value as shown in FIG. 12. The difference between the value H and L increases as the temperature of the $O_2$ sensor rises to the active region, and the range of the $O_2$ concentration of the intermediate value is narrow. When the contents of the counter exceeds the specified value $C_S$, the temperature of the $O_2$ sensor will reach the active region. Thus, if the $O_2$ sensor operates normally, the output of the $O_2$ sensor is surely larger than the value $O_2$ (1) or smaller than the value $O_2$ (2).

The RPMIN program processing will again be described with reference to FIG. 11.

When the processing at step S14 or S15 is finished, the $O_2$ sensor fault examination routine 268 completes, and the cooling water temperature sensor fault examination routine 270 follows. At step S16, data TW from the TWS 134 (FIG. 4) is stored in the RAM 106 at the address C 106.

At the next step S17 where the same processing is made as at the step S12, if the result is NO, the program proceeds directly to the EXIT 260. If the result is YES, the program proceeds to step S18 where decision is made whether the data TW is larger than the specified value TWS or not.

If the result at step S18 is NO, the program proceeds to step S19 where the water temperature sensor fault flag F3 at address C 103 in the RAM 106 is set. If the result at step S18 is YES, the water temperature sensor fault flag F3 is reset at step S 20. When the processing at step S19 or S20 is finished, the water temperature fault examination routine 270 is completely executed to end the RPMIN program.

The contents of the $O_2$ sensor fault flag F2 and water temperature sensor fault flag F3 in the RAM 106 are informed by lamp indication to the driver.

FIG. 13 shows a flow chart of the program LAMDA for controlling the air-to-fuel ratio of the carburetor. This program is activated by the QUEUE from the INTV IRQ 230 at each 40 m seconds. At step S1, it is checked whether the count end flag F1 in FIG. 8 is at level "1" or not. If the result at the step is NO, open loop control for air/fuel ratio is performed because the warming up of engine is not completely performed yet. In other words at step S32, data of the engine speed N in the RAM 106 at address C 103 and the negative suction pressure $V_c$ of engine at address C 106 therein are used, and the map AFMAP stored at addresses B600 to B6FF in the ROM 104 is read, to obtain a map duty DM. The address C 107 of the RAM 106 is the area in which the DM is temporarily set. At step S33, the read map duty DM is set in the register CABD in FIG. 4. Thus, the slow solenoid 16 and the main solenoid are controlled to open or close at the duty ratio stored in the map AF MAP. At step S34, the duty DF value at address C 107 in the RAM 106 is made equal to DM for the start of closed loop control.

If the result at step S30 is YES, or if the warming-up of engine is completely performed, the program proceeds to step S31 where the $O_2$ sensor fault flag F2 is checked. If the flag is "1", the open loop control is performed similarly as in the above. On the other hand, if the $O_2$ sensor fault flag F2 is "0" level, the closed loop control for air/fuel ratio is performed at steps S35 to S45. First, at step S35, the engine speed N in the RAM 106 at address C 103 is read, and then at step S36, the control gain proportional to the engine speed N is set. The control gain in this case is the amount added or subtracted at a time at step S40, S41, S42 or S43. At step S37, decision is made of whether the $O_2$ data set in the RAM 106 at address C 105 is larger than a predetermined sliced level $O_2$ (SL) or not. If the result at step S37 is YES, since the oxygen concentration in the exhaust gas is low, or the gas mixture to be supplied to the engine is rich, the duty ratio DF based on the $O_2$ data is reduced to make the gas mixture lean. At step S39, if the mixture is decided to have been changed from lean state to rich state in this flow, the program proceeds to step S43. At step S43, a predetermined proportional part KP is substracted from the duty ratio DF set in the RAM 106 at address C108 and the value is again set at the address C 108. If the result at step S39 is NO, i.e., if the rich state continues or the closed loop control starts, the program proceeds to step S42. At step S42, integrated portion KI for gradually decreasing the duty ratio DF is subtracted from DF and the value is again set at address C 108. On the other hand, the result at S37 is NO, or if the gas mixture is lean, the program proceeds to step S38, where decision is made of whether the mixture is changed from rich state to lean state or not. If the result at step S38 is YES, the proportional portion KP is added to the DF at step S40. If the result at step S38 is NO, the integrated portion KI is added to the DF at step S41. Thus, although the duty ratio DF increasing or decreasing depending on the value of the $O_2$ data is set in the register CABD as shown in FIG. 4 to enable the closed loop control for air/fuel ratio, this embodiment further adds the variation of the map duty DM to this value thereby to perform very swift control. In other words, at step S44, the previous map duty DM stored in the RAM 106 at address C 107 is compared with the map duty read at this time, the difference therebetween, or the variation $\Delta DM$ is computed, and the DM read at this time is set at address C 107 for the next computation. Then, at step S 45, the variation $\Delta M$ of the map duty is added to the duty ratio DF set in the RAM 106 at address C 108, and the sum is set in the register CABD.

In the embodiment of this invention as described above, the number of revolutions of engine at an engine speed exceeding a predetermined value is accumulated in accordance with the flow chart of the program in FIG. 7, the failure examination for the sensor as shown in FIG. 11 is performed when the accumulated value exceeds a predetermined value, and the closed loop control using the $O_2$ data is selected in the control flow of the air/fuel ratio as shown in FIG. 13. Thus, the closed loop control of the air/fuel ratio surely starts at a proper time independent of warming-up way of engine. Moreover, the sensor failure is immediately examined. Therefore, a high-reliability engine control system is achieved. Furthermore, to check the functions of the control system, if a pulse signal of a short period is supplied instead of the ignition signal, the accumulated value reaches a predetermined value in a very short time to set the count end flag. Therefore, the functions can be checked easily. Moreover, although not shown in the flow charts, the recirculation of exhaust gas by the system as shown in FIG. 3 can be performed only when the count end flag is set, and therefore, the recirculation of the exhaust gas is started at a proper time.

I claim:

1. A control system for an internal combustion engine comprising:

counting means for accumulating a count value in synchronism with a rotation of the engine from a time when the engine starts, wherein said counting means accumulates said count value only when the engine speed exceeds a predetermined value;

displaying means set when the accumulated value of said counting means reaches a predetermined value;

electrically controlled valve means provided in at least one of an air and fuel supplying system to control the air/fuel ratio of a fuel-air mixture being supplied to the engine;

a sensor provided in an exhaust system of the engine to generate an output signal proportional to an oxygen concentration in the exhaust gas of the engine; and control units for supplying to said electrically controlled valve means a control output signal in response to the output signal from said sensor after said display means is set, and a control output signal independent of the output signal from said sensor before said display means is set.

2. A control system for internal combustion engine according to claim 1, further comprising failure examining means for examining a failure of said sensor on the basis of whether the output signal of said sensor reaches a predetermined value or not when said displaying means is set.

3. A control system for internal combustion engine according to claim 1, wherein said counting means accumulates said count valve in synchronism with an ignition signal to the engine.

4. A control system for internal combustion engine according to claim 1, further comprising reset means for resetting the accumulated value of said counting means to zero when the engine speed is lowered from a predetermined value.

5. A control system for controlling an air/fuel ratio of a fuel-air mixture to an internal combustion engine, the control system comprising:

means for producing output signals indicative of an operating condition of the engine including an output signal in synchronism with a rotation of the engine and an output signal representing a temperature of a coolant of the engine;

a sensor means provided in an exhaust system of the engine for generating an output signal in accordance with an oxygen concentration in exhaust gas from the engine;

electrically controlled valve means for controlling the air/fuel ratio of the air-fuel mixture supplied to the engine;

control means for supplying to said electrically controlled valve means control output signals, said control means being adapted to count the output signals in synchronism with the rotation of the engine from a time when the engine starts and when the engine speed exceeds a predetermined value and to supply control output signals to said electrically controlled valve means independent of the output signal of the sensor means before a counted value of the output signal in synchronism with the rotation of the engine counted during a time period in which the engine speed exceeds the predetermined value satisfies a present value and to supply control output signals in response to the output signal of said sensor means after said counted value satisfies said preset value.

6. A control system according to claim 5, wherein said control means sets the counted value of the signal in synchronism with the rotation of the engine at zero if the counted valve does not reach the preset value during the time period in which the engine speed is above the predetermined value.

7. A control system according to claim 5, wherein said means for producing the output signal in synchronism with the rotation of the engine includes a reference crank angle sensor means for producing a reference output signal, and the reference output signal is counted as the output signal in synchronism with the rotation of the engine.

8. A control system according to claim 5, wherein said means for producing the signal in synchronism with the rotation of the engine includes a crank angle position sensor means for producing an angle position output signal, said control means is adapted to calculate the the engine speed upon receipt of the angle position output signal.

9. A control system according to claim 5, wherein said control means is adapted to examine a failure of said sensor means on a basis of whether the output signal of said sensor means reaches a predetermined value in amplitude after the counted value of the output signal in synchronism with the rotation of the engine reaches the preset value.

10. A control system according to claim 9, further comprising means for indicating a failure of said sensor means examined by said control means.

11. A control system according to claim 5, wherein said control means is adapted to examine a failure of said means for producing the coolant temperature signal on the basis of whether the coolant temperature output signal reaches a preset value after the counted value of the output signal in synchronism with the rotation of the engine reaches a preset value.

12. A control system according to claim 11, further comprising means for indicating a failure of said means for producing a coolant temperature output signal examined by said control means.

13. A control system according to claim 5, wherein said control means includes a central processing unit, a read only memory, and a random access memory.

* * * * *